US005947524A

United States Patent [19]

Podosek

[11] Patent Number: 5,947,524

[45] Date of Patent: Sep. 7, 1999

[54] COVER FOLDER

[75] Inventor: Edward Podosek, Wilbraham, Mass.

[73] Assignee: Avery Dennison Corporation, Pasadena, Calif.

[21] Appl. No.: 08/728,213

[22] Filed: Oct. 10, 1996

Related U.S. Application Data

[63] Continuation-in-part of application No. 08/713,398, Sep. 13, 1996, abandoned, which is a continuation-in-part of application No. 08/555,487, Nov. 8, 1995, abandoned.

[51] Int. Cl.[6] ..... B42D 3/10; B42D 17/00

[52] U.S. Cl. ..... 281/45; 281/46; 281/48; 281/38; 281/21.1; 402/79; 402/80 R

[58] Field of Search ..... 281/45, 46, 48, 281/28, 29, 34, 35, 49, 15.1, 21.1, 30, 31, 51, 42, 38; 402/45, 46, 74, 80 R, 17, 79; 412/34; 24/67.1, 67.3

[56] References Cited

U.S. PATENT DOCUMENTS

| | | | |
|---|---|---|---|
| D. 381,041 | 7/1997 | Lammers et al. | D19/32 |
| 3,363,390 | 1/1968 | Crane et al. . | |
| 4,934,738 | 6/1990 | Colonna | 281/45 |
| 5,865,469 | 2/1999 | Chin | 281/45 |

FOREIGN PATENT DOCUMENTS 2145033 3/1985 United Kingdom .

*Primary Examiner*—Frances Han
*Attorney, Agent, or Firm*—Kriegsman & Kriegsman

[57] ABSTRACT

A cover folder having a binder and a cover. The binder includes an elongated channel shaped member having a pair of oppositely facing side walls and a pair of ribs, the side walls converging at a slit and defining an interior slot along the length of the elongated channel shaped member. Each rib protrudes into the slot from the interior side of one of the side walls in a direction away from the slit and at an acute angle with the side wall from which it protrudes. The cover is slidably and removably mounted in the binder and includes a sheet and an elongated strip, the sheet being folded to form a pair of cover sheets having a common folded edge. The elongated strip has a lock portion and a securing portion. At least a portion of the securing portion is secured to the exterior side of one of the pair of cover sheets close to the common folded edge and the lock portion protrudes in a direction away from the common folded edge and forms an acute angle at its intersection with the sheet from which the strip is secured. When the cover is inserted into the interior slot of said binder the lock portion of the elongated strip on the cover sheet extends up into the area between the rib and its respective side wall so as to retain the cover within the binder even when the cover is opened.

22 Claims, 3 Drawing Sheets

COVER FOLDER

CROSS-REFERENCE TO RELATED APPLICATIONS

This application is a continuation-in-part of U.S. patent application Ser. No. 08/713,398, filed on Sep. 13, 1996 in the name of Edward Podosek and assigned to the assignee of this application now abandoned which, in turn, is a continuation-in-part of U.S. patent application Ser. No. 08/554,487 filed on Nov. 8, 1995 in the name of Edward Podosek and assigned to the assignee of this application now abandoned.

BACKGROUND OF THE INVENTION

The present invention relates generally to cover folders and more specifically to cover folders for securely holding and covering a stack of paper.

Various kinds of cover folders are utilized to hold papers for business and school reports.

In a cover folder of a well-known type, a sheet of either plastic or paper is folded to form a pair of sheets having a common folded edge and the papers comprising the report are placed between the two sheets with the left side edge of the papers arranged adjacent and parallel to the common folded edge. An elongated plastic or metal binder is slid onto the outside of the common folded edge of the cover. Such binders are generally formed by two elongated panels that are joined along a common edge, with a narrow opening opposite the common edge through which the cover may be inserted. The elongated panels of the binder resiliently press and hold the opposing leafs of the cover and the enclosed papers together.

A major drawback prevalent in many prior art cover folders of the type described above is that because the binder can be readily removed by sliding it either parallel to or at an angle relative to the folded edge, very often when the cover sheet is opened and separated, even with only small force, it tends to separate from its binder, particularly as the number of pages of the report increases. As a result, the enclosed papers may become soiled or disorganized. In particular, there generally is insufficient friction between the binder and the cover sheet to keep the two together. As a consequence, an adhesive or other binding element has been employed in the art to ensure secure engagement.

Some report covers comprising a binder and a cover have been provided with auxiliary binder clips or fasteners which must be inserted through the binder, the cover, and the sheets of paper held therein. The binder may, in any event, be retained to provide additional holding force or to improve the outer appearance of the report cover. The use of auxiliary components for holding the report papers together can result in the need to locate the edges of the pages at a distance away from the folded edge. Accordingly, the overall width of the cover must be increased to provide proper coverage for papers of standard size.

The use of additional clips, fasteners, supports, staples and the provision of additional cover area to properly accommodate the papers necessarily increases the overall cost of the report cover. Also the use of additional fasteners makes it more difficult and time consuming for the user to insert and remove the sheets. Moreover, certain types of report documents may not have sufficient margins for providing holes for the passage of fasteners. Also, it may otherwise be undesirable to form holes in the report pages in order to accommodate the fasteners. Holes are undesirable because, among other things, sheets secured by holes tend to tear during normal handling, and aesthetically, the appearance of such documents are greatly detracted.

As a consequence, attempts have been made to construct cover folders which do not require an adhesive or other binding element to ensure secure engagement. An example of such a cover folder is disclosed in U.S. Pat. No. 4,486,032 to Leahy, which issued on Dec. 4, 1984. In this patent, there is disclosed a cover folder having a binder that securely retains the cover and inserted sheets, without the use of external fasteners. The binder is an elongated bar with an interior channel for receiving and holding a folded cover. The bar includes within the channel slanted ribs which engage the folded edge of the cover sheet along an overlapping flap. The overlapping flap of the cover sheet may be made more rigid by heat treatment and/or by a reinforcing coating.

Another report cover is disclosed in U.S. Pat. No. 4,575,123 to Giblin et al., which issued on Mar. 11, 1986. In this patent, a folded report cover is provided with a lock strip extending along at least one side of the cover parallel and contiguous to the fold and outwardly of the plane of the side. A channel-shaped gripping member is engaged to the cover along the fold and locked in place by a stop which extends from the interior of one leg of the gripping member into resilient engagement with a longitudinal edge of the lock strip and the one side of the cover. The other leg of the gripping member engages the opposite side of the cover. The lock strip is preferably an integral portion of the material of the cover.

Other examples include U.S. Pat. No. 5,226,676 to K. J. Su, U.S. Pat. No. 4,904,104 to F. Gloeckle, U.S. Pat. No. 4,867,479 to S. Mizutani, U.S. Pat. No. 4,682,792 to G. Simmons, U.S. Pat. No. 4,521,035 to J. W. Berezowsky, U.S. Pat. No. 4,402,530 to G. Daguerre, U.S. Pat. No. 4,351,546 to C. Cognata, and U.S. Pat. No. 936,223 to J. N. Dean.

SUMMARY OF THE INVENTION

It is an object of the present invention to provide a new and improved cover folder.

It is another object of the present invention to provide a cover folder having a cover which is securely held in a binder without the use of external fastening devices.

It is yet another object of the present invention to provide a cover folder having a cover and a binder and wherein the binder securely holds the cover and inserted sheets even when the cover is opened.

It is still another object of the present invention to provide a cover folder of the type containing a binder and a cover, wherein the cover is readily insertable and removable from the binder.

It is a further object of the present invention to provide a cover folder which may be mass produced, has a minimal number of parts, and can be easily assembled.

According to this invention, a cover folder is provided which includes a binder and a cover, the binder having a rib, the cover including a pair of cover sheets and an elongated strip, the elongated strip being secured to one of the pair of cover sheets, the rib cooperating with the elongated strip when the cover is inserted into the binder so as to retain the cover within the binder even when the cover is opened.

According to one embodiment of the present invention, a cover folder is provided which includes a binder and a cover, said binder comprising an elongated channel shaped member having a pair of oppositely facing side walls and a rib, said side walls defining an interior slot along the length of the elongated channel shaped member, the side walls each having an interior side and an exterior side, the side walls converging at a slit, said rib protruding into the slot from the interior side of one of the side walls in a direction away from the slit and at an acute angle with the side wall from which the rib protrudes, said cover being slidably and removably mounted in said binder, said cover comprising a single sheet and an elongated strip, said single sheet being folded to form a pair of cover sheets having a common folded edge, each cover sheet having an interior side and an exterior side, the body of each of the pair of cover sheets being separable from one another, said elongated strip having a lock portion and a securing portion, the securing portion being secured to the exterior side of one of the pair of cover sheets, the lock portion protruding in a direction away from the common folded edge and forming an acute angle at its intersection with the cover sheet from which the strip is secured, wherein said cover is inserted into the interior slot of said binder so that the lock portion of said elongated strip on said cover sheet extends up into the area between the rib and its respective side wall so as to retain the cover within the binder even when the cover is opened.

According to yet another embodiment of the present invention, a cover folder is provided which comprises a binder and a cover, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes, said cover being slidably and removably mounted in said binder, said cover comprising a single sheet and a pair of elongated strips, said sheet being folded to form a pair of cover sheets having a common folded edge, each sheet having an interior side and an exterior side, the body of each of the pair of sheets being separable from one another, each elongated strip having a lock portion and a securing portion, the securing portion of each elongated strip being secured to the exterior side of one of the pair of sheets, the lock portion of each elongated strip protruding in a direction away from the common folded edge and forming an acute angle at its intersection with the sheet from which the strip is secured, wherein said cover is inserted into the interior slot of said binder so that the lock portion of each elongated strip extends up into the area between a rib and its respective side wall so as to retain the cover within the binder even when the cover is opened.

According to another embodiment of the invention, a cover folder is provided which comprises a binder and a cover, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes, said cover being slidably and removably mounted in said binder, said cover comprising a single sheet and an elongated strip, said sheet being folded to form a pair of cover sheets having a common folded edge, each sheet having an interior side and an exterior side, the body of each of the pair of sheets being separable from one another, said elongated strip having a pair of lock portions and a securing portion, the securing portion being secured to the exterior side of each one of the pair of sheets, each lock portion protruding in a direction away from the common folded edge and forming an acute angle at its intersection with one of the sheets, wherein said cover is inserted into the interior slot of said binder so that each lock portion extends up into the area between a rib and its respective side wall so as to retain the cover within the binder even when the cover is opened.

According to still another embodiment of the invention, a cover folder is provided which comprises a binder and a cover, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes, said cover being slidably and removably mounted in said binder, said cover comprising a single sheet and an elongated strip, said single sheet being folded to form a pair of cover sheets having a common folded edge, each sheet having an interior side and an exterior side, the body of each of the pair of sheets being separable from one another, said elongated strip having a pair of lock portions and a securing portion, the securing portion being secured to the common folded edge of the pair of sheets, each lock portion protruding in a direction away from the common folded edge and forming an acute angle at its intersection with one of the sheets, wherein said cover is inserted into the interior slot of said binder so that each lock portion extends up into the area between a rib and its respective side wall so as to retain the cover within the binder even when the cover is opened.

According to a further embodiment of the present invention, a cover folder is provided which includes a binder and a cover, said binder comprising an elongated channel shaped member having a pair of oppositely facing side walls and a rib, said side walls defining an interior slot along the length of the elongated channel shaped member, the side walls each having an interior side and an exterior side, the side walls converging at a slit, said rib protruding into the slot from the interior side of one of the side walls in a direction away from the slit and at an acute angle with the side wall from which the rib protrudes, said cover being slidably and removably mounted in said binder, said cover comprising a pair of cover sheets and an elongated strip, each cover sheet having an interior side, an exterior side, a first edge and a second edge, said pair of cover sheets being secured together in the vicinity of their first edges, said elongated strip having a lock portion and a securing portion, the securing portion being secured to the exterior side of one of the pair of sheets in the vicinity of its first edge, the lock portion protruding in a direction away from the first end and forming an acute angle at its intersection with the cover sheet from which the strip is secured, wherein said cover is inserted into the interior slot of said binder so that the lock portion of said elongated strip on said cover sheet extends up into the area between the rib and its respective side wall so as to retain the cover within the binder even when the cover is opened.

According to still a further embodiment of the present invention, a cover folder is provided which comprises a binder and a cover, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes, said cover being slidably and removably mounted in said binder, said cover comprising a pair of cover sheets and a pair of elongated strips, each cover sheet having an interior side, an exterior side, a first edge and a second edge, said pair of cover sheets being secured together in the vicinity of their first edges, each elongated strip having a lock portion and a securing portion, the securing portion of each elongated strip being secured to the exterior side of one of the pair of cover sheets in the vicinity of its first edge, the lock portion of each elongated strip protruding in a direction away from the first end and forming an acute angle at its intersection with the cover sheet from which the strip is secured, wherein said cover is inserted into the interior slot of said binder so that the lock portion of each elongated strip extends up into the area between a rib and its respective side wall so as to retain the cover within the binder even when the cover is opened.

According to yet another embodiment of the invention, a cover folder is provided which comprises a binder and a cover, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes, said cover being slidably and removably mounted in said binder, said cover comprising a pair of cover sheets and an elongated strip, each cover sheet having an interior side, an exterior side, a first edge and a second edge, said pair of cover sheets being secured together in the vicinity of their first edges, said elongated strip having a pair of lock portions and a securing portion, the securing portion being secured to the exterior side of each one of the pair of cover sheets, each lock portion protruding in a direction away from the first end of the cover sheet to which it is secured and forming an acute angle at its intersection with one of the cover sheets, wherein said cover is inserted into the interior slot of said binder so that each lock portion extends up into the area between a rib and its respective side wall so as to retain the cover within the binder even when the cover is opened.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 4(*a*) is a section view of the binder shown in FIG. 4 before it is mounted on the cover;

DETAILED DESCRIPTION OF A PREFERRED EMBODIMENT

Figure 1:
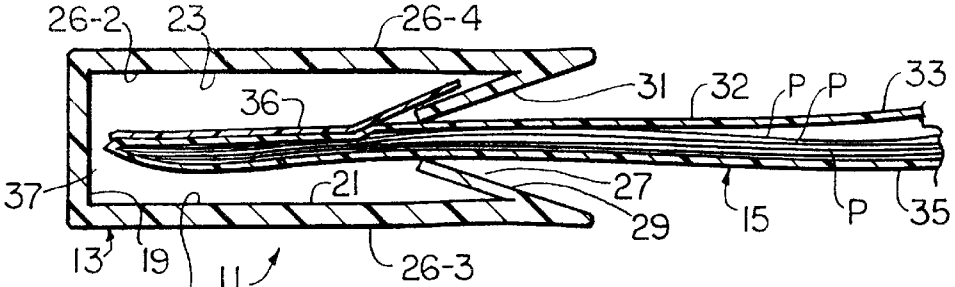
FIG. 1 is a sectional view broken away in part of one embodiment of a cover folder constructed according to the teachings of the present invention, with papers being shown inserted therein.
Figure 3:
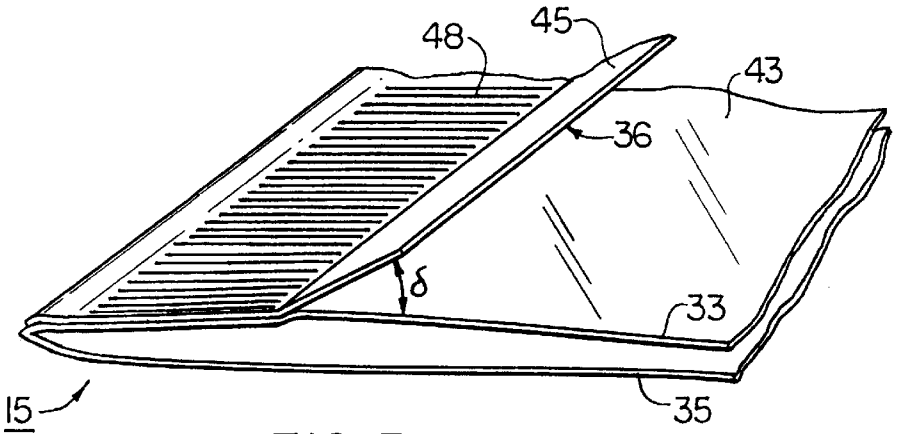
FIG. 3 is a perspective view of the cover shown in FIG. 2.

Referring now to the drawings and more particularly to FIG. 1, there is shown a first embodiment of a cover folder constructed according to the teachings of the present invention, the cover folder being represented generally by reference numeral 11. Those aspects of cover folder 11 not pertinent to the present invention are neither described nor shown herein. In FIG. 1 cover folder 11 is shown holding together a plurality of papers P.

Cover folder 11 is comprised of a binder 13 and a cover 15, cover 15 being slidably and removably mounted within binder 13.

Binder 13 is an elongated channel shaped member composed of a thermoplastic material suitable for use in a one step extrusion, such as polystyrene, polypropylene, polyvinylchloride, or nylon and includes a back wall 19 and a pair of oppositely facing parallel side walls 21 and 23 which together define an interior slot 25. Side walls 21 and 23 each include an interior side 26-1 and 26-2, respectively, an exterior side 26-3 and 26-4, respectively, and are curved so as to define a slit 27 along its length. Side walls 21 and 23 are shaped so as to resiliently press and hold cover 15 and enclosed papers P together.

Binder 13 also includes a pair of ribs 29 and 31 which protrude into slot 25 from the interior side 26-1 and 26-2, respectively of side walls 21 and 23, respectively, away from slit 27. Preferably, ribs 29 and 31 extend along at least a major portion of the length of channel shaped member 19, most preferably along its entire length. Ribs 29 and 31 face each other in slanted arrangement so that an acute angle $\gamma$ is formed between the intersection of ribs 29 and 31 with side walls 21 and 23, respectively, measured on the side farthest away from slit 27 and so that an obtuse angle $\alpha$ is formed between ribs 29 and 31.

Cover 15, which is slidably and removably mounted within binder 13, comprises a single sheet 32 of plastic, such as polyvinylchloride, polystyrene, or polypropylene, which is folded to form a pair of sheets 33 and 35. Sheets 33 and 35 include a common folded edge 37 and an opening 39 at its opposite edge so that the body of sheets 33 and 35 are separable from one another. Sheets 33 and 35 include an interior side 41 and 42, respectively, and an exterior side 43 and 44, respectively. Sheets 33 and 35 serve to protect and aesthetically improve the overall condition of papers P contained therewithin. This is accomplished by inserting papers P through opening 39 between sheets 33 and 35 so that the left side edge of papers P is arranged adjacent and parallel to common folded edge 37. Binder 13 can then be slid over common folded edge 37 of sheets 33 and 35 to secure cover 15 and papers P in place.

Cover 15 additionally comprises an elongated strip 36 constructed of a plastic such as polyvinylchloride, polystyrene, or polypropylene. Strip 36 includes a lock portion 45 and a securing portion 47. Strip 36 is fixedly secured to exterior side 43 of sheet 33, preferably by radio frequency or ultrasonic welding in the vicinity of common folded edge 37. As can be seen, strip 36 is secured to side 43 over a portion of securing portion 47, the portion being identified by reference numeral 48. Instead of welding strip 36 to side 43 over only a portion thereof, the entire securing portion 47 could be secured to side 43. Lock portion 45 protrudes in a direction away from common folded edge 37 and sheet 33. Lock portion 45 forms an acute angle $\delta$ at its intersection with exterior side 43 of sheet 33. Strip 36 is positioned on side 43 of sheet 33 so that when binder 13 is slid onto cover 15 over common folded edge 37, lock portion 45 extends up between side wall 23 and slanted rib 31. Lock portion 45 serves to effectively lock cover 15 in slot 25, limiting the movement of binder 13 relative to cover 15 along a path parallel to common folded edge 37. Cover 15 and papers P are held securely within binder 13 by the engagement of lock portion 45 with slanted rib 31 and side wall 23, so that cover 15 and papers P will not slip out of binder 13 when cover 15 is opened. Cover 15 and papers P can only be removed by sliding binder 13 off cover 15 in a direction parallel to common folded edge 37. If desired, end portion 48 can also be fixedly secured to side 43 of sheet 33.

Instead of two ribs, the binder could have only one rib. For example, rib 27 in binder 13 could be eliminated and sidewall 21 could be made outwardly convex.

To use cover folder 11 the following steps may be taken. Binder 13 is slid off of cover 15 along the length of common folded edge 37, if not already separated. Papers P are then arranged adjacent and placed in parallel to common folded edge 37. Then, binder 13 is slid onto cover 15 and papers P over common folded edge 37 in a direction parallel to folded edge 37. Binder 13 resiliently presses and holds cover 15 and papers P together in place. Lock portion 45 of elongated strip 36 extends between side wall 23 and slanted rib 31, thereby preventing binder 13 from being pulled off of cover 15 in any direction which is not parallel common folded edge 37.

Figure 4A:
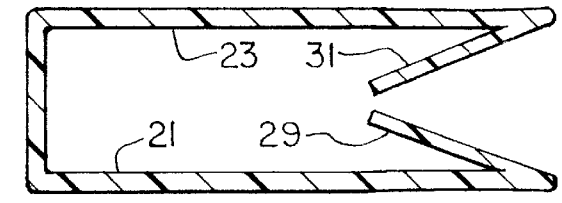
FIG. 4 is an perspective view of the binder shown in the cover folder in FIG. 1 as it appears after it is mounted on the cover.
Figure 2:
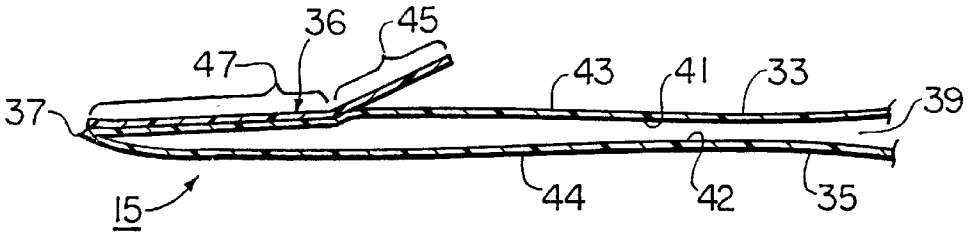
FIG. 2 is a section view of the cover in the cover folder of FIG. 1.
Figure 4:
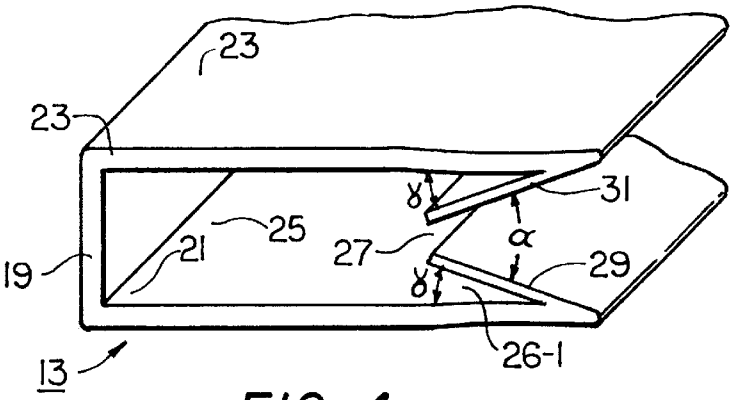

FIG. 4 shows binder 13 as it appears after it is mounted on cover 13 and FIG. 4(*a*) shows binder 13 as it appears before it is mounted on cover 13. As can be seen in FIG. 4(*a*), prior to mounting, the tips of ribs 29 and 31 almost touch each other whereas in FIG. 4 the tips of ribs 29 and 31 are farther apart.

Figure 6:
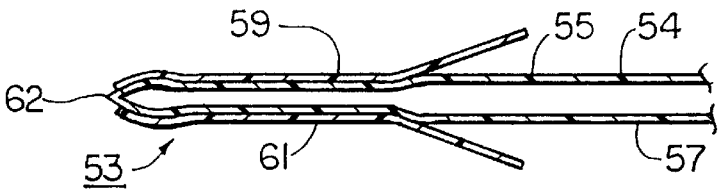
FIG. 6 is a section view of the cover in the cover folder in FIG. 5.
Figure 5:
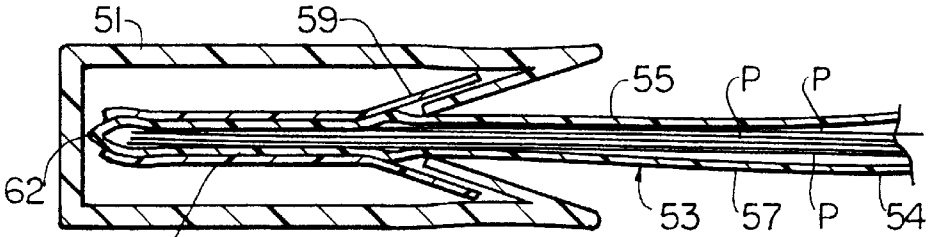
FIG. 5 is a section view of another embodiment of a cover folder constructed according to the teachings of the present invention, with papers being shown inserted therein.

FIG. 5 illustrates another embodiment of a cover folder according to this invention, the cover folder being represented by reference numeral 50. The cover portion of cover folder 50 is shown separately in FIG. 6. Cover folder 50 includes a binder 51 identical to binder 13 and a cover 53. Cover 53 includes a single sheet 54 folded to form a pair of cover sheets 55 and 57 identical to cover sheets 33 and 35. However, instead of a single strip 36 as in cover folder 11, cover folder 50 includes two strips 59 and 61, one strip 59 being fixedly secured to sheet 55 such as by welding and the other strip 61 being fixedly secured to sheet 57 such as by welding, each strip being secured to a sheet in the vicinity of the common folded edge 62. The implementation of a pair of strips 59 and 61 rather than a single strip 36 allows for increased locking of binder 51 on cover 53 and papers P which are included therewithin.

Figure 7:
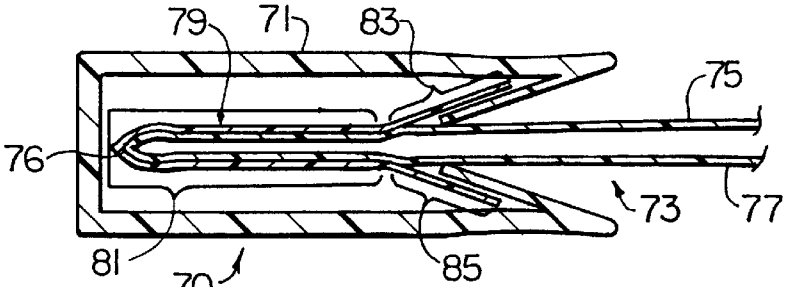
FIG. 7 is a section view of another embodiment of a cover folder constructed according to this invention, with papers being shown inserted therein.

FIG. 7 illustrates another embodiment of the present invention, the cover folder being represented by reference numeral 70. Cover folder 70 includes a binder 71 identical to binder 51 and a cover 73. Cover 73 includes a pair of cover sheets 75 and 77 identical to cover sheets 55 and 57. However, instead of having two strips 59 and 61, in which one strip 59 is secured to one sheet 55 and the other strip 61 is secured to the other sheet 57, cover folder 70 includes a single strip 79 having a securing portion 81 between a pair of lock portions 83 and 85. Securing portion 81 is secured to sheet 75 and to sheet 77, including folded edge 76, such as by welding, so that each of end portions 83 and 85 extends up into the area between its associated sidewall and respective rib.

Figure 8:
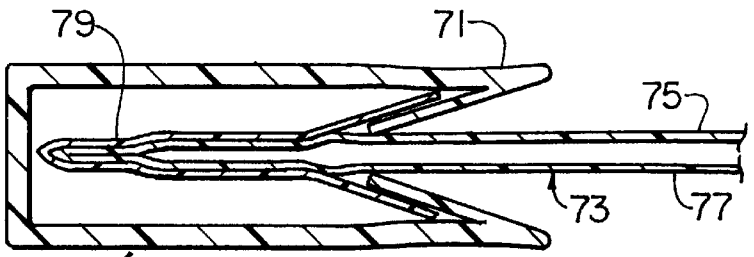
FIG. 8 is a section view of another embodiment of a cover folder constructed according to this invention, with papers being shown inserted therein.

FIG. 8 illustrates another embodiment of the present invention, the cover folder being represented by reference numeral 90. Cover folder 90 differs from cover folder 70 only in the manner in which strip 79 is secured to cover 73. More specifically, instead of strip 79 being welded to sheet 75 and also to sheet 77, strip 79 is secured to sheets 75 and 77 by a four layer pinch weld, i.e. strip 79 is welded to sheet 75 which is welded to sheet 77 which is welded to strip 79.

Figure 9:
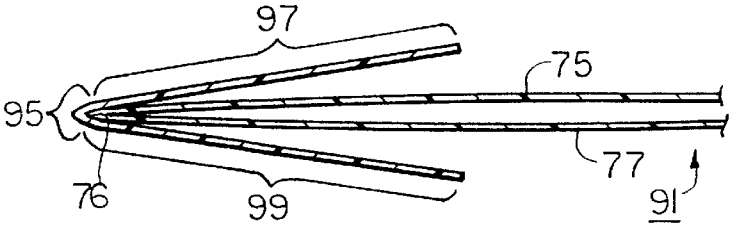
FIG. 9 is a section view of a modification of the cover in the cover folder shown in FIG. 7.

FIG. 9 illustrates a modification of cover 73 shown in FIG. 7, the modification being identified by reference numeral 91. Cover 91 has a securing portion 95 and a pair of lock portions 97 and 99; however, securing portion 95 is shorter than securing portion 81 and welded only onto folded edge 76 rather than sheets 75 and 77 and folded edge 76 as in cover 73. Also, as can be seen, lock portions 97 and 99 are longer than lock portions 83 and 85.

Figure 10:
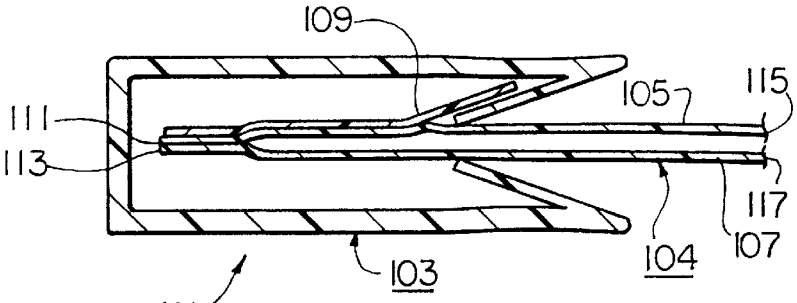
FIG. 10 is a section view of another embodiment of a cover folder constructed according to the teachings of the present invention.

FIG. 10 illustrates another embodiment of the present invention, the cover folder being represented by reference numeral 101. Cover folder 101 includes a binder 103 and a cover 104. Binder 103 is identical to binder 13. Cover 104 includes a pair of cover sheets 105 and 107 and an elongated strip 109. Cover sheets 105 and 107 each include a first edge 111 and 113, respectively, and a second edge 115 and 117. Cover sheets 105 and 107 are welded together in the vicinity of their first edges 111 and 113. Strip 109 is identical to strip 36 and is welded to cover sheet 105 in the vicinity of first edge 111. Preferably, strip 109 is welded to cover sheet 105 and cover sheet 105 is welded to sheet 107 in one pinch welding operation. As can be appreciated, this arrangement of welding two sheets together eliminates the need to fold a single sheet to form two cover sheets as in cover 15, which reduces production costs.

Figure 11:
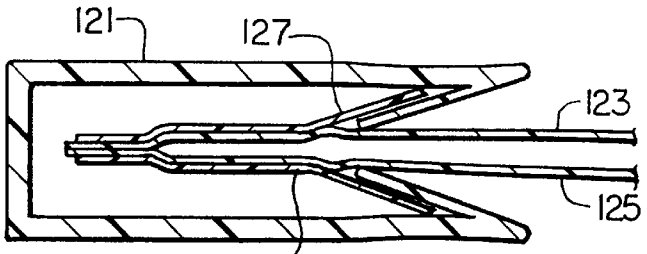
FIG. 11 is a section view of another embodiment of a cover folder constructed according to the teachings of the present invention.

FIG. 11 illustrates another embodiment of the present invention, the cover folder being represented by reference numeral 119. Cover folder 119 includes a binder 121 identical to binder 103 and a pair of sheets 123 and 125 identical to sheets 105 and 107 respectively. Cover folder 125 differs from cover folder 101 only in that there are two elongated strips 127 and 129 rather than one strip 109, strip 127 being secured to sheet 123 and strip 129 being secured to sheet 125. Strips 127 and 129 and sheets 123 and 125 are secured together in one pinch welding operation.

Figure 12:
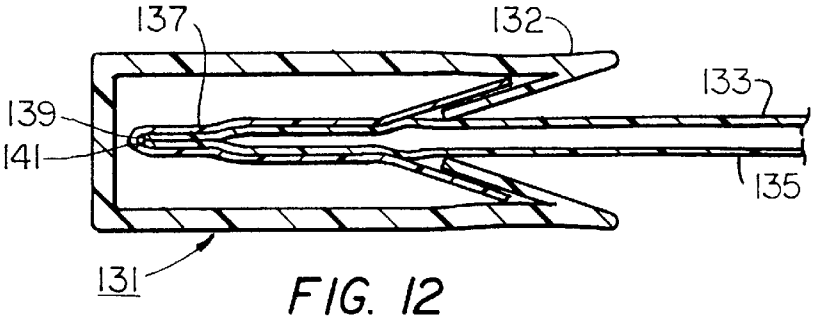
FIG. 12 is a section view of another embodiment of a cover folder constructed according to the teachings of the present invention.

FIG. 12 illustrates another embodiment of the present invention, the cover folder being represented by reference numeral 131. Cover folder 131 includes a binder 132 identical to binder 121, a pair of cover sheets 133 and 135 identical to cover sheets 123 and 125 and an elongated strip 137 identical to elongated strip 79. Cover sheets 133 and 135 are welded together in the vicinity of their first edges 139 and 141 and strip 137 is welded to sheet 133 and 135 in the vicinity of first edges 139 and 141 in the same arrangement as strip 79 is welded to sheets 75 and 77. Strip 137 and sheets 133 and 135 are preferably welded together in one pinch welding operation.

Figure 13:
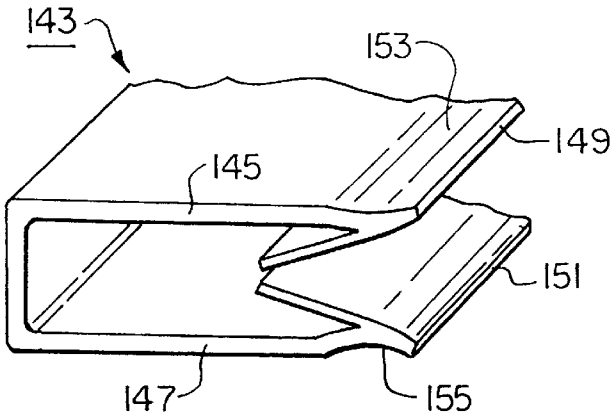
FIG. 13 is a fragmentary perspective view of a modification of the binder shown in FIG. 4.

A modification in the shape of binder 11 is shown in FIG. 13, the modified binder being identified by reference numeral 143. As can be seen in FIG. 13, sidewalls 145 and 147 of binder 143 are concave near outer ends 149 and 151, the concave portions being identified by reference numerals 153 and 155.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims. For example, instead of being made of plastic, the elongated strips could be made of paperboard or a mixture of paperboard and plastic.

What is claimed is:

1. A cover folder comprising:

a) a binder, said binder comprising an elongated channel shaped member having a pair of oppositely facing side walls and a rib, said side walls defining an interior slot along the length of the elongated channel shaped member, the side walls each having an interior side and an exterior side, the side walls converging at a slit, said rib protruding into the slot from the interior side of one of the side walls in a direction away from the slit and at an acute angle with the side wall from which the rib protrudes; and b) a cover, said cover being slidably and removably mounted in said binder, said cover comprising a sheet and an elongated strip, said sheet being folded to form a pair of sheets having a common folded edge, each sheet having an interior side and an exterior side, the body of each of the pair of sheets being separable from one another, said elongated strip being bent to define a lock portion and a securing portion, the securing portion being secured over at least a portion thereof to the exterior side of one of the pair of sheets, the lock portion protruding in a direction away from the common folded edge and forming an acute angle at its intersection with the sheet from which the strip is secured;

c) wherein said cover is inserted into the interior slot of said binder so that the lock portion of said elongated strip on said cover sheet extends up into the area between the rib and its respective side wall so as to retain the cover within the binder even when the cover is opened.

2. The cover folder as claimed in claim 1, wherein said elongated strip extends along the length of the common folded edge.

3. The cover folder as claimed in claim 2, wherein said elongated strip is spaced away from the common folded edge, along the length of the common folded edge.

4. The cover folder as claimed in claim 3, wherein said elongated strip is secured to the exterior side of one of the pair of sheets by radio frequency welding.

5. The cover folder as claimed in claim 1, wherein said elongated strip is made of plastic.

6. A cover folder comprising:

a) a binder, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes; and b) a cover, said cover being slidably and removably mounted in said binder, said cover comprising a sheet and a pair of elongated strips, said sheet being folded to form a pair of sheets having a common folded edge, each sheet having an interior side and an exterior side, the body of each of the pair of sheets being separable from one another, each elongated strip being bent to define a lock portion and a securing portion, the securing portion of each elongated strip being secured over at least a portion thereof to the exterior side of one of the pair of sheets, the lock portion of each elongated strip protruding in a direction away from the common folded edge and forming an acute angle at its intersection with the sheet from which the strip is secured;

c) wherein said cover is inserted into the interior slot of said binder so that the lock portion of each elongated strip extends up into the area between a rib and its respective side wall so as to retain the cover within the binder even when the cover is opened.

7. The cover folder as claimed in claim 6, wherein said pair of elongated strips extend along the length of the common folded edge, one on each side thereof.

8. The cover folder as claimed in claim 7, wherein said pair of elongated strips are secured along the length of the common folded edge.

9. The cover folder as claimed in claim 8, wherein said pair of elongated strips are secured to the exterior side of said pair of sheets by radio frequency welding.

10. The cover folder as claimed in claim 6, wherein said elongated strips are made of plastic.

11. A cover folder comprising:

a) a binder, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes; and b) a cover, said cover being slidably and removably mounted in said binder, said cover comprising a sheet and an elongated strip, said sheet being folded to form a pair of sheets having a common folded edge, each sheet having an interior side and an exterior side, the body of each of the pair of sheets being separable from one another, said elongated strip being bent to define a pair of lock portions and a securing portion, the securing portion being secured to the exterior side of each one of the pair of sheets, each lock portion protruding in a direction away from the common folded edge and forming an acute angle at its intersection with one of the sheets;

c) wherein said cover is inserted into the interior slot of said binder so that each lock portion extends up into the area between a rib and its respective side wall so as to retain the cover within the binder even when the cover is opened.

12. The cover folder as claimed in claim 11, wherein said elongated strip extends along the length of the common folded edge.

13. The cover folder as claimed in claim 12, wherein said lock portions extend along the length of the common folded edge, one on each side thereof.

14. The cover folder as claimed in claim 12, wherein said securing portion is secured to the exterior side of said pair of sheets by radio frequency welding.

15. The cover folder as claimed in claim 11, wherein said elongated strip is made of plastic.

16. A cover folder comprising:

a) a binder, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes; and b) a cover, said cover being slidably and removably mounted in said binder, said cover comprising a sheet and an elongated strip, said sheet being folded to form a pair of sheets having a common folded edge, each sheet having an interior side and an exterior side, the body of each of the pair of sheets being separable from one another, said elongated strip being bent to define a pair of lock portions and a securing portion, the securing portion being secured to the common folded edge of the pair of sheets, each lock portion protruding in a direction away from the common folded edge and forming an acute angle at its intersection with one of the sheets;

c) wherein said cover is inserted into the interior slot of said binder so that each lock portion extends up into the area between a rib and its respective side wall so as to retain the cover within the binder even when the cover is opened.

17. A cover folder comprising:

a) a binder, said binder comprising an elongated channel shaped member having a pair of oppositely facing side walls and a rib, said side walls defining an interior slot along the length of the elongated channel shaped member, the side walls each having an interior side and an exterior side, the side walls converging at a slit, said rib protruding into the slot from the interior side of one of the side walls in a direction away from the slit and at an acute angle with the side wall from which the rib protrudes; and b) a cover, said cover being slidably and removably mounted in said binder, said cover comprising a pair of cover sheets and an elongated strip, each cover sheet having a first edge, said cover sheets being secured together in the vicinity of their first edges, said elongated strip being secured to one of said cover sheets in the vicinity of its first edge;

c) wherein said cover is inserted into the interior slot of said binder so that a portion of said elongated strip extends up into the area between the rib and its respective side wall so as to retain the cover within the binder even when the cover is open.

18. The cover folder as claimed in claim 17, wherein said cover sheets are secured to each other and the elongated strip is secured to one the cover sheets by welding.

19. A cover folder comprising:

a) a binder, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes; and b) a cover, said cover being slidably and removably mounted in said binder, said cover comprising a pair of cover sheets and a pair of elongated strips, each cover sheet having a first edge said cover sheets being secured together in the vicinity of their first edges and one elongated strip being secured to each clover sheet in the vicinity of its first edge;

c) wherein said cover is inserted into the interior slot of said binder so that a portion of each elongated strip extends up into the area between a rib and its respective side wall so as to retain the cover within the binder even when the cover is opened.

20. The cover folder as claimed in claim 19, wherein said cover sheets are welded together and said elongated strips are secured to their respective cover sheets by welding.

21. A cover folder comprising:

a) a binder, said binder comprising an elongated channel shaped member having a pair of oppositely facing side walls and a pair of ribs, said side walls defining an interior slot along the length of the elongated channel shaped member, the side walls each having an interior side and an exterior side, the side walls converging at a slit, one rib protruding into the slot from the interior side of each one of the side walls in a direction away from the slit and at an acute angle with the side wall from which the rib protrudes; and b) a cover, said cover being slidably and removably mounted in said binder, said cover comprising a pair of cover sheets and an elongated strip, said pair of cover sheets being secured together, said elongated strip having a pair of lock portions and a securing portion, the securing portion being secured to each one of the pair of sheets, each lock portion protruding in a direction away from the common welded edge and forming an acute angle at its intersection with one of the sheets;

c) wherein said cover is inserted into the interior slot of said binder so that each lock portion extends up into the area between a rib and its respective side wall so as to retain the cover within the binder even when the cover is opened.

22. The cover folder as claimed in claim 21, wherein said elongated strip is welded to the exterior side of each one of the pair of cover sheets and said pair of cover sheets are welded together.

* * * * *